US006840168B2

(12) United States Patent
Itoh et al.

(10) Patent No.: US 6,840,168 B2
(45) Date of Patent: Jan. 11, 2005

(54) PAPER SHEET STAMP APPARATUS

(75) Inventors: Shinichi Itoh, Kawasaki (JP); Yukio Asari, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/437,241

(22) Filed: May 14, 2003

(65) Prior Publication Data

US 2003/0213383 A1 Nov. 20, 2003

(30) Foreign Application Priority Data

May 14, 2002 (JP) ..... 2002-138514

(51) Int. Cl.[7] ..... B41L 47/46; B41L 3/02; B41F 13/24

(52) U.S. Cl. ..... 101/91; 101/235; 101/486

(58) Field of Search ..... 101/486, 91, 236, 101/232, 235, 2, 233; 400/120.09; 209/578; 156/539

(56) References Cited

U.S. PATENT DOCUMENTS

| | | | | | |
|---|---|---|---|---|---|
| 2,887,951 | A | * | 5/1959 | Strother et al. | 101/232 |
| 2,976,803 | A | * | 3/1961 | Van Marle | 101/236 |
| 4,023,489 | A | | 5/1977 | Beery | 101/235 |
| 4,178,847 | A | * | 12/1979 | Erhardt | 101/91 |
| 4,220,084 | A | | 9/1980 | Maclean et al. | 101/235 |
| 5,012,735 | A | * | 5/1991 | Fischer et al. | 101/177 |
| 5,122,967 | A | * | 6/1992 | Gilham | 700/235 |
| 5,373,761 | A | * | 12/1994 | Brining | 83/13 |
| 5,408,927 | A | * | 4/1995 | Gallagher et al. | 101/232 |
| 5,471,928 | A | | 12/1995 | Dimur et al. | 101/235 |
| 5,813,347 | A | | 9/1998 | Baumann | 101/486 |
| 5,871,290 | A | * | 2/1999 | Fujimoto et al. | 400/151.1 |
| 5,988,057 | A | * | 11/1999 | Salomon et al. | 101/91 |
| 6,277,230 | B1 | * | 8/2001 | Milko | 156/230 |
| 6,328,394 | B1 | * | 12/2001 | Shirai et al. | 347/2 |
| 6,446,958 | B1 | * | 9/2002 | Sette et al. | 271/225 |
| 6,464,819 | B1 | * | 10/2002 | Sette et al. | 156/256 |
| 6,644,659 | B2 | * | 11/2003 | Skadow et al. | 271/265.02 |

FOREIGN PATENT DOCUMENTS

| | | | | |
|---|---|---|---|---|
| EP | 0 177 057 A2 | | 4/1986 | |
| JP | 2-11382 | * | 1/1990 | B41K/3/64 |
| JP | 8-10710 | | 1/1996 | |
| JP | 10-244742 | * | 3/1997 | B41K/3/00 |

* cited by examiner

*Primary Examiner*—Charles H. Nolan, Jr.
*Assistant Examiner*—Wasseem H. Hamdan
(74) *Attorney, Agent, or Firm*—Pillsbury Winthrop LLP

(57) ABSTRACT

A stamp apparatus having a conveying belt pair for conveying a mail matter in an arrow T direction, sensor for detecting the conveyed mail matter, a stamp hub which roll-contacts a postage stamp portion of the mail matter, rotates, and stamps the portion with a postmark, and a backup roller for pressing the conveyed mail matter onto the stamp hub. The stamp hub is directly connected to the AC servo motor, and is rotated at a speed equal to a conveying speed of the mail matter, when a effective region contacts the mail matter.

5 Claims, 3 Drawing Sheets

PAPER SHEET STAMP APPARATUS

CROSS-REFERENCE TO RELATED APPLICATIONS

This application is based upon and claims the benefit of priority from prior Japanese Patent Application No. 2002-138514, filed May 14, 2002.

BACKGROUND OF THE INVENTION

1. Field of the Invention

The present invention relates to a paper sheet stamp apparatus which stamps the surface of a paper sheet conveyed at a constant speed.

2. Description of the Related Art

Paper sheet stamp apparatuses have heretofore been known such as a stamp apparatus for stamping a portion of a mail matter conveyed at a high speed, to which a postage stamp is attached, with a postmark.

This type of the stamp apparatus includes: a conveying belt pair running at a constant speed in a holding state of the opposite surfaces of the mail matter; a stamp hub for stamping a postage stamp portion of the conveyed mail matter with the postmark; and a backup roller rotatably disposed opposite to the stamp hub on a back-surface side of the mail matter. The backup roller presses the mail matter conveyed by the conveying belt pair onto the stamp hub by urging means such as a spring.

The stamp hub substantially has a D-shaped section formed by cutting out a part of an outer peripheral surface, and a letterpress for the postmark is formed on the outer peripheral surface. The cutout portion of the stamp hub is stopped in a home position disposed opposite to a conveying path in an initial state. Moreover, during rotation, the letterpress on the outer peripheral surface of the stamp hub is pressed onto the postage stamp portion of the mail matter to stamp the portion with the postmark.

In general, the stamp hub is rotated by a driving force transmitted from a conveying motor for allowing the conveying belt pair to run. That is, the stamp hub is connected to the conveying motor via a clutch brake. Therefore, the clutch brake is connected in accordance with a timing when the mail matter is conveyed, and the stamp hub is rotated from the home position. Accordingly, the letterpress is pressed onto the postage stamp portion to stamp the portion with the postmark.

However, in the above-described conventional stamp apparatus, the clutch brake is connected and the driving force is transmitted to the stamp hub. It has therefore been difficult to rotate the stamp hub at the same peripheral speed as the conveying speed of the mail matter and to rotate the stamp hub at an appropriate timing. Therefore, when the letterpress of the stamp hub is pressed on the postage stamp portion of the mail matter, a speed difference is generated between the letterpress and mail matter. There is a problem that the postmark warps or deviates.

BRIEF SUMMARY OF THE INVENTION

The present invention has been developed in consideration of the above-described respects, and an object thereof is to provide a paper sheet stamp apparatus which can securely and clearly stamp a surface predetermined position of a paper sheet conveyed at a relatively high speed.

According to an aspect of the present invention, there is provided a paper sheet stamp apparatus comprising: a conveying mechanism which conveys a paper sheet at a constant speed via a conveying path; a sensor which detects the conveyed paper sheet; a stamp hub which stamps a first surface of the paper sheet detected by the sensor; a backup roller which rotates in a rolling contact with a second surface of the paper sheet so as to press the first surface of the paper sheet onto the stamp hub; and a first driving portion which independently drives the stamp hub so as to rotate the stamp hub at the constant speed, when at least the stamp hub contacts the paper sheet.

According to another aspect of the present invention, there is provided a paper sheet stamp apparatus comprising: a conveying mechanism which conveys a paper sheet at a constant speed via a conveying path; a sensor which detects the conveyed paper sheet; a stamp hub which stamps a first surface of the paper sheet detected by the sensor; a backup roller which rotates in a rolling contact with a second surface of the paper sheet so as to press the first surface of the paper sheet onto the stamp hub; a first driving portion which accelerates the stamp hub so that the stamp hub reaches the constant speed until the paper sheet conveyed via the conveying path contacts the stamp hub and which decelerates and stops the accelerated stamp hub; and a clutch which interrupts a driving force transmitted to the stamp hub from the first driving portion to rotate the stamp hub following the paper sheet conveyed at the constant speed, when the stamp hub contacts the paper sheet.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be described hereinafter in detail with reference to the drawings.

Figure 1:
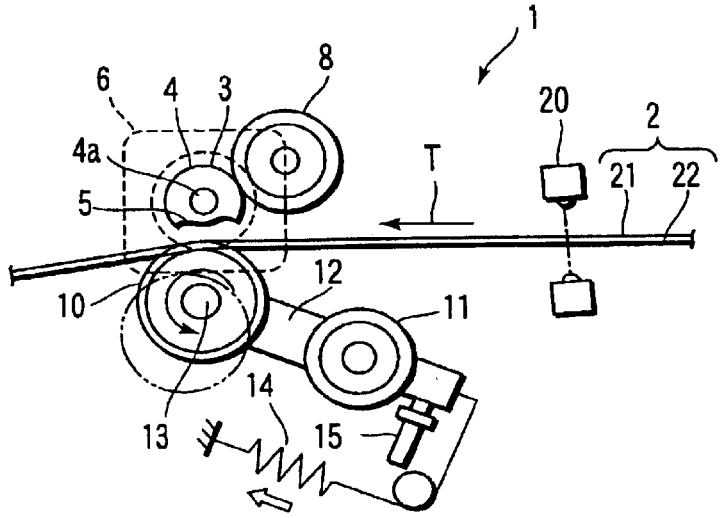
FIG. 1 is a front view showing a schematic structure of a stamp apparatus according to a first embodiment of the present invention.

FIG. 1 shows a schematic structure of a stamp apparatus 1 (paper sheet stamp apparatus) according to a first embodiment of the present invention. Here, the stamp apparatus 1 will be described for stamping a portion of a mail matter conveyed at a relatively high speed (3.8 m/s in the present embodiment), to which a postage stamp is attached (hereinafter referred to simply as the postage stamp portion), with a postmark.

The stamp apparatus 1 includes a conveying belt pair 2 (conveying mechanism) which runs in an arrow T direction in the drawing at a constant speed in a holding/binding state of the mail matter. In further detail, the conveying belt pair 2 includes: a conveying belt 21 extended to be brought in a face contact with the surface (first surface) on a side to which the postage stamp is attached; and a conveying belt 22 disposed opposite to the conveying belt 21 via a conveying path and extended to be brought in the face contact with the surface (second surface) of the mail matter on an opposite side.

Here, the apparatus including one pair of conveying belts 21, 22 will be described. However, a plurality of pairs of belts may be extended/arranged along a conveying direction in a positional relation via the conveying path.

In a position brought in a rolling contact with the first surface of the mail matter conveyed by the conveying belt pair 2, a substantially cylindrical stamp hub 4 for stamping the postage stamp portion with a postmark is disposed. The stamp hub 4 has the rolling contact with the first surface of the mail matter in a predetermined position deviating on a rear side (paper surface inner direction) of the apparatus from the conveying belt 21. The stamp hub 4 has a section formed substantially in a D-shape. In the outer peripheral surface of the hub, an effective region 3 in which a letterpress (not shown) for the postmark is formed, and a non-contact region 5 which does not contact the first surface of the mail matter during rotation are continuously disposed along a rotation direction.

The stamp hub 4 is stopped in a home position (position shown in FIG. 1) where the non-contact region 5 is disposed opposite to the conveying path in an initial state. This prevents the stamp hub 4 from contacting the mail matter conveyed via the conveying path. Moreover, a gap adjustment mechanism (not shown) for adjusting a gap between the hub and conveying path is disposed in the stamp hub 4.

A rotation shaft 4*a* of the stamp hub 4 is directly connected to an AC servo motor 6 (first driving portion) having an output of 200 [W]. The AC servo motor 6 has a characteristic that a torque larger than that at a steady rotation time is generated at an acceleration/deceleration time, and is therefore appropriate for a driving source of the stamp hub 4 in which a timing of acceleration/deceleration needs to be switched with a high precision.

Figure 2:
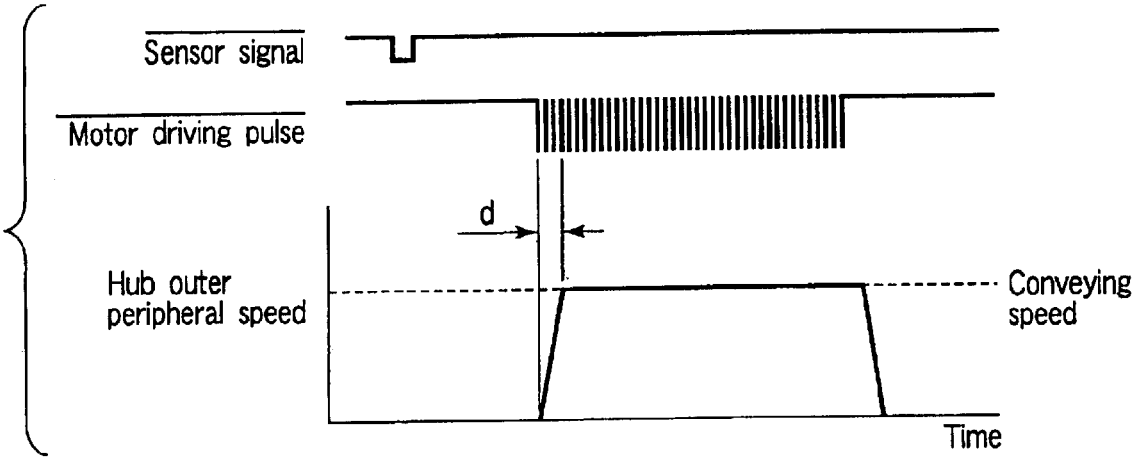
FIG. 2 is a timing chart showing an operation of a stamp hub of the stamp apparatus of FIG. 1.

FIG. 2 shows a state of a speed change at an operation time of the stamp hub 4. In the present embodiment, a pulse signal is supplied to the AC servo motor 6 to drive/control the hub.

As shown in FIG. 2, when the mail matter is detected by a sensor 20 (FIG. 1), a driving pulse signal having a predetermined frequency is supplied to a motor driver (not shown) at an adjusted timing. The AC servo motor 6 rotates the stamp hub 4 based on the driving pulse signal, but the hub cannot momentarily be accelerated up to a predetermined speed. Therefore, a constant delay time d is generated until the predetermined speed is reached. The delay time d is determined by the stamp hub 4 and a peripheral inertial system, and is constant. In consideration of this, a rotation start timing of the AC servo motor 6 is adjusted.

In the present embodiment, for the motor driving pulse, the pulse having a constant frequency corresponding to the conveying speed is supplied, an automatic correction function of the AC servo motor 6 is used, and an acceleration/deceleration time is set to be constant. That is, when the number of pulses for one rotation of the stamp hub 4 is supplied, a series of operation is automatically performed, and thereafter the hub stops in an initial position. Therefore, frequency modulation for acceleration/deceleration, and the like may not be performed, and the series of operation is performed with a simple control.

An ink supply roller 8 (ink supply portion) for supplying an ink to the letterpress is brought in the rolling contact with the outer peripheral surface of the stamp hub 4. The ink supply roller 8 includes a sponge portion soaked with an ink in the outer periphery of the roller.

In a position disposed opposite to the stamp hub 4 via the conveying path, a backup roller 10 is disposed. The backup roller 10 rotates in the rolling contact with the second surface of the mail matter so as to press the first surface of the mail matter conveyed via the conveying path onto the effective region 3 of the stamp hub 4. That is, the backup roller 10 is also disposed in a position deviating on the rear side of the apparatus from the conveying belt 22.

Figure 3:
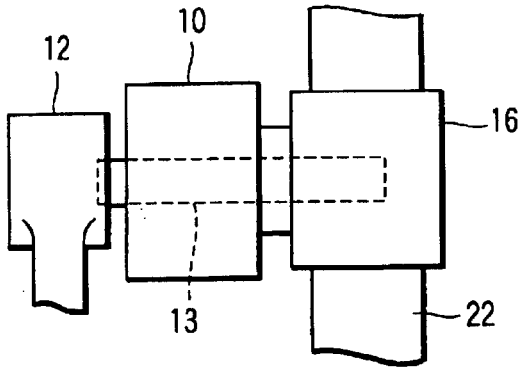
FIG. 3 is a diagram showing a structure for transmitting a driving force of a conveying belt to a backup roller of the stamp apparatus of FIG. 1.

The backup roller 10 is rotatably disposed on the tip end of rocking of an arm 12 disposed so that the arm can rock centering on a rotation shaft 11. In more detail, as shown in FIG. 3, the backup roller 10 is attached to a rotation shaft 13 projecting from the tip end of the arm 12 so that the roller can rotate. Moreover, by an urging force of a spring 14 connected to a base end of the arm 12, the backup roller 10 is pressed/disposed toward the outer peripheral surface of the stamp hub 4. It is to be noted that a stopper 15 for regulating a rotation position of the arm 12 urged by the spring 14 is disposed in a position adjacent to the base end of the arm 12. The stopper 15 regulates the rocking of the arm 12 in a position where the outer peripheral surface of the backup roller 10 is brought in the rolling contact with the effective region 3 of the stamp hub 4 with a predetermined pressure.

Furthermore, as shown in FIG. 3, the backup roller 10 rotates by the driving force transmitted from the conveying belt 22. That is, a driving transmission roller 16 in the rolling contact on the back-surface side of the conveying belt 22 is fixed/disposed adjacent to and coaxially with the backup roller 10. The driving transmission roller 16 is rotated by the running of the conveying belt 22 so that the backup roller 10 is rotated. Therefore, the backup roller 10 rotates at the running speed of the conveying belt 22, that is, at the same peripheral speed as the conveying speed of the mail matter. It is to be noted that in the present embodiment, the conveying belt 22 is a flat belt, but a toothed belt obtained by attaching teeth to the back-surface side of the conveying belt 22 may also be used while the driving transmission roller 16 is replaced with a gear.

In the present embodiment, the backup roller 10 having a diameter of 50 mm is used to allow the driving transmission roller 16 having a diameter of 48 mm to abut on the conveying belt 22 having a thickness of 1.2 mm. Accordingly, the backup roller 10 is rotated at a speed equal to the conveying speed.

Figure 4A:
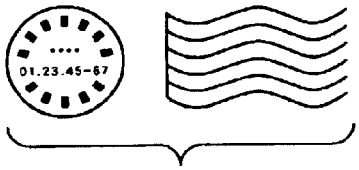
FIG. 4A is a diagram showing an imprint in a case in which the backup roller of the stamp apparatus of FIG. 1 is rotated at a speed equal to a conveying speed.

When the backup roller 10 is rotated at the speed equal to the conveying speed in this manner, normal stamping is possible with good reproducibility. FIG. 4A shows an imprint on the mail matter stamped by the stamp apparatus 1 of the present embodiment in which the backup roller 10 is rotated at the speed equal to the conveying speed.

Figure 4B:
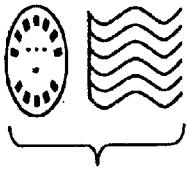
FIG. 4B is a diagram showing the imprint in a case in which the backup roller of the stamp apparatus of FIG. 1 is stopped.

On the other hand, FIG. 4B shows the imprint stamped without rotating the backup roller 10. In this case, the mail matter decelerates, the rotation speed of the stamp hub 4 becomes higher than the conveying speed of the paper sheet, and the imprint has a contracted state along the conveying direction.

Figure 4C:
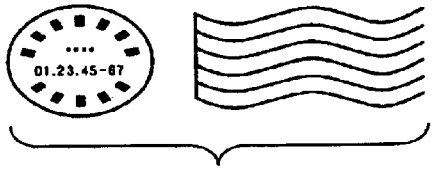
FIG. 4C is a diagram showing the imprint in a case in which the backup roller of the stamp apparatus of FIG. 1 is rotated at a speed higher than the conveying speed.

Moreover, FIG. 4C shows the imprint in a case in which the backup roller 10 is rotated at a speed higher than the conveying speed and the mail matter is stamped. In this case, the mail matter is accelerated, the rotation speed of the stamp hub 4 becomes lower than the conveying speed of the mail matter, and the imprint has an extended state along the conveying direction.

That is, when the backup roller 10 is rotated at the speed equal to the conveying speed as in the present embodiment, the normal stamping is possible with the good reproducibility.

Next, an acceleration/deceleration operation of the stamp hub 4 of the stamp apparatus 1 structured as described above will be described.

When the mail matter is conveyed in an arrow T direction via the conveying path and detected via the sensor 20, the rotation of the AC servo motor 6 is started at a predetermined timing and the rotation of the stamp hub 4 is started. The stamp hub 4 is stopped in a posture (home position) in which the non-contact region 5 is disposed opposite to the conveying path in the initial state before conveying the mail matter. From this state, the acceleration is started.

A rotation start timing of the AC servo motor 6 is set to be adjusted to a timing at which the letterpress of the effective region 3 of the stamp hub 4 is pressed onto the postage stamp portion of the conveyed mail matter. Moreover, the acceleration of the stamp hub 4 at this time is set to an acceleration such that the peripheral speed of the outer peripheral surface reaches the conveying speed (3.8 m/s) of the mail matter at a time when the effective region 3 starts contacting the first surface of the mail matter, that is, when the stamp hub 4 starts contacting the mail matter.

Moreover, the AC servo motor 6 rotates the stamp hub 4 at the same constant peripheral speed as the conveying speed of the mail matter, while the effective region 3 of the stamp hub 4 has the rolling contact with the first surface of the mail matter, that is, in a state in which the stamp hub 4 contacts the mail matter. Accordingly, at a stamping operation time when the letterpress disposed in the effective region 3 of the stamp hub 4 is pressed onto the postage stamp portion in the first surface of the mail matter, a speed difference can be prevented from being generated between the mail matter and stamp hub 4, and the predetermined position can securely and clearly be stamped with the postmark.

Furthermore, after the effective region 3 of the stamp hub 4 is detached from the first surface of the mail matter, that is, after the stamp hub 4 does not contact the mail matter any more, the AC servo motor 6 decelerates and stops the stamp hub 4 in the home position. That is, the deceleration of the AC servo motor 6 at this time is set to a value at which the stamp hub 4 stops in the home position.

In other words, the stamp hub 4 is rotated/controlled so that a series of acceleration/constant-speed/deceleration operation is completed during one rotation at the above-described timing.

As described above, according to the present embodiment, at a stamping operation time when the letterpress disposed in the outer peripheral surface of the stamp hub 4 is pressed onto the postage stamp portion of the mail matter to stamp the portion with the postmark, the AC servo motor 6 is rotated/controlled so that the stamp hub 4 rotates at the same peripheral speed as the conveying speed of the mail matter. Therefore, the speed difference can be prevented from being generated between the stamp hub 4 and mail matter, and the postmark with respect to the postage stamp portion can securely and clearly be imprinted.

Moreover, according to the present embodiment, the driving force is transmitted from the conveying belts 21, 22 for conveying the mail matter in the holding/binding state, so that the backup roller 10 is rotated at the same peripheral speed as the conveying speed. Therefore, when the mail matter passes between the backup roller 10 and stamp hub 4, the backup roller 10 rotates at the same peripheral speed as the conveying speed of the mail matter. This can prevent an undesired load from being supplied to the mail matter from the backup roller 10. That is, according to the present embodiment, the conveying speed of the mail matter can be prevented from changing by the load from the backup roller 10, and the postage stamp portion can securely and clearly be stamped with the postmark.

On the other hand, as in the related art, the mail matter is conveyed in a state in which the backup roller 10 stops. Then, when the mail matter contacts the backup roller 10, the mail matter receives a large load, the conveying speed of the mail matter changes, the speed difference is generated between the stamp hub 4 and mail matter, and the imprint warps. The present invention can solve such disadvantage.

It is to be noted that for the stamp apparatus 1 of the above-described embodiment, the apparatus including the AC servo motor 6 directly connected to the rotation shaft of the stamp hub 4 has been described. However, the stamp hub 4 may also be connected to the AC servo motor 6 via a driving force transmission mechanism such as a belt.

Figure 5:
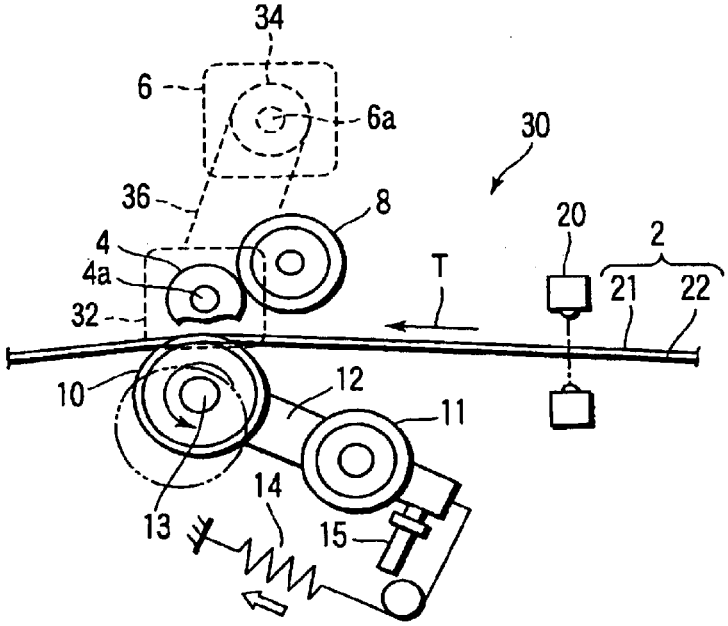
FIG. 5 is a front view showing the schematic structure of the stamp apparatus according to a second embodiment of the present invention.

Next, a stamp apparatus 30 according to a second embodiment of the present invention will be described with reference to FIG. 5. This stamp apparatus 30 has substantially the same structure as that of the stamp apparatus 1 of the first embodiment except that an electromagnetic clutch 32 is disposed between the stamp hub 4 and AC servo motor 6. Therefore, constituting elements functioning in the same manner as those of the stamp apparatus 1 are denoted with the same reference numerals, and the detailed description thereof is omitted.

An endless belt 36 for transmitting the driving force is wound and extended between a pulley 34 attached to a rotation shaft 6*a* of the AC servo motor 6 and a driving input end (not shown) of the electromagnetic clutch 32. Moreover, the rotation shaft 4*a* of the stamp hub 4 is directly connected to a driving output end (not shown) of the electromagnetic clutch 32.

When the electromagnetic clutch 32 is connected, the driving force of the AC servo motor 6 is transmitted to the stamp hub 4 via the pulley 34, belt 36, and electromagnetic clutch 32, and the stamp hub 4 is rotated. At this time, the rotation speed of the stamp hub 4 is set to be equal to the conveying speed of the mail matter. On the other hand, when the electromagnetic clutch 32 is disconnected, the driving force transmitted from the AC servo motor 6 is interrupted, and the driving force is not transmitted to the stamp hub 4. At this time, the stamp hub 4 rotates following the mail matter in a state in which the hub is brought in the rolling contact with the first surface of the mail matter conveyed via the conveying path.

That is, the stamp apparatus 30 operates as follows.

In the stamp apparatus 30 of the present embodiment, the AC servo motor 6 is rotated in a standby state before the mail matter is conveyed. Moreover, when the mail matter is conveyed in the arrow T direction via the conveying path and detected via the sensor 20, the electromagnetic clutch 32 is connected at a predetermined timing. The driving force of the AC servo motor 6 is transmitted to the stamp hub 4, and the stamp hub 4 starts rotating.

The timing to connect the electromagnetic clutch 32 is set to a timing at which the peripheral speed of the outer peripheral surface reaches the conveying speed (3.8 m/s) of the mail matter, at the time when the stamp hub 4 stopped in the home position starts rotating and the effective region 3 contacts the first surface of the mail matter, that is, when the stamp hub 4 starts contacting the mail matter.

Moreover, at the timing when the effective region 3 of the stamp hub 4 roll-contacts the first surface of the mail matter, that is, at the timing when the stamp hub 4 contacts the mail matter, the electromagnetic clutch 32 is disconnected and the driving force transmitted to the stamp hub 4 from the AC servo motor 6 is interrupted. Immediately after this, the stamp hub 4 roll-contacts the first surface of the mail matter conveyed via the conveying path and rotates following the mail matter. Furthermore, the letterpress (not shown) disposed in the effective region 3 is pressed onto the postage stamp portion in the first surface of the mail matter to imprint the postmark.

In the state in which the stamp hub 4 rotates following the mail matter, the postage stamp portion is stamped with the postmark in this manner. Accordingly, at the stamp operation time, the speed difference can substantially completely be prevented from being generated between the mail matter and stamp hub 4, and the postmark can securely and clearly be imprinted in the predetermined position.

Furthermore, after the effective region 3 of the stamp hub 4 is detached from the first surface of the mail matter, that is, after the stamp hub 4 does not contact the mail matter any more, the electromagnetic clutch 32 is connected, and the stamp hub 4 is decelerated and stopped in the home position.

As described above, according to the present embodiment, at the stamp operation time when the letterpress disposed in the outer peripheral surface of the stamp hub 4 is pressed onto the postage stamp portion of the mail matter to imprint the postmark, the driving force transmitted to the stamp hub 4 is interrupted and the stamp hub 4 is rotated following the mail matter. Therefore, the speed difference can substantially completely be prevented from being generated between the letterpress and postage stamp portion, and the postmark with respect to the postage stamp portion can securely and clearly be imprinted.

Especially when a relatively thick mail matter is treated, the mail matter is easily decelerated while passing through the stamp hub 4. Therefore, as in the present embodiment, it becomes effective to rotate/control the stamp hub 4. That is, the stamp hub 4 rotating following the mail matter decelerates together with the mail matter. Therefore, even when the mail matter undesirably decelerates at the stamp time, the speed difference can be prevented from being generated between the mail matter and stamp hub 4.

Figure 6:
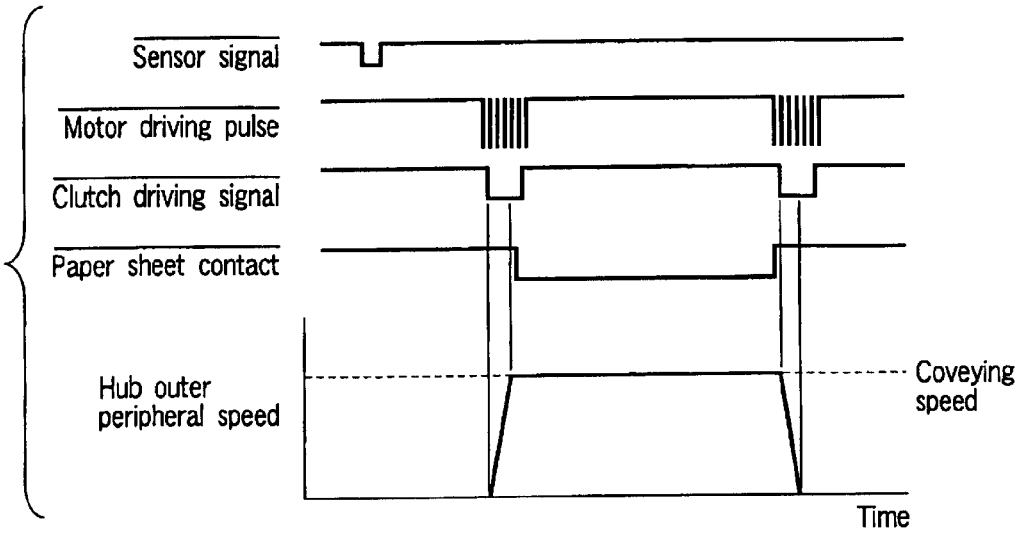
FIG. 6 is a timing chart showing the operation of the stamp hub of the stamp apparatus of FIG. 5.

FIG. 6 shows the state of the speed change at the operation time of the stamp hub 4 in detail.

At the rotation start time of the stamp hub 4 (acceleration time), the driving pulse is supplied to a motor driver (not shown), the electromagnetic clutch is connected, and the stamp hub 4 is rotated until the hub reaches the conveying speed. The motor driving pulse is set to be longer than a time when the electromagnetic clutch is connected.

Subsequently, when the stamp hub 4 contacts the mail matter, the electromagnetic clutch is disconnected, and the stamp hub 4 is freely rotated. At this time, if the electromagnetic clutch is disconnected before bringing the stamp hub 4 in contact with the mail matter, there is a possibility that the peripheral speed of the stamp hub 4 does not reach the conveying speed of the mail matter. In a worst case, the stamp hub 4 does not rotate following the mail matter. Therefore, after the stamp hub 4 contacts the mail matter, the electromagnetic clutch is disconnected.

To stop the stamp hub 4, the electromagnetic clutch is again operated, the driving pulse is supplied to the motor driver, and the stamp hub 4 is decelerated. Here, to prevent the stamping from being influenced at a stop time, after the stamping completely ends, the electromagnetic clutch is connected.

It is to be noted that in the present embodiment, the motor driving pulse is supplied only at the acceleration/deceleration time. However, even if the motor driving pulse is supplied all through the rotation of the stamp hub 4, there is no problem. That is, when the electromagnetic clutch 32 is switched/controlled at the above-described timing, the AC servo motor 6 may constantly be rotated.

Figures 7A, 7B, 7C:
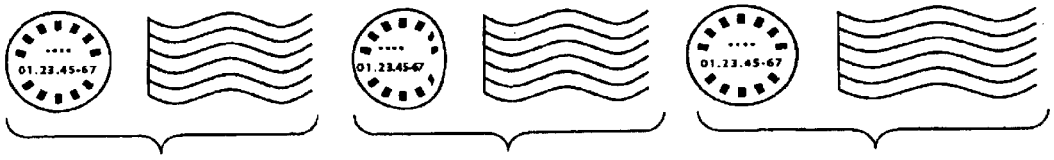
FIG. 7A is a diagram showing the imprint in a case in which the backup roller of the stamp apparatus of FIG. 5 is rotated following the mail matter.
FIGS. 7B, 7C are diagrams showing the imprints in a case in which the driving force is continuously given to the backup roller of the stamp apparatus of FIG. 5.

In any case, while the stamp hub 4 contacts the mail matter, the driving force is interrupted. Accordingly, the normal stamping with better reproducibility is possible. FIG. 7A shows the imprint of the postmark imprinted on the mail matter by the stamp apparatus 30 of the present embodiment. The imprint indicates a shape without any distortion as original.

On the other hand, FIGS. 7B, 7C show the imprints of the postmarks in a case in which the driving force constantly continues to be supplied to the stamp hub 4 at the stamp time. FIG. 7B shows that a round portion of the imprint has warped because of transmission unevenness of the clutch, and FIG. 7C shows that a wavy line portion of the imprint is elongated. Moreover, this distortion also appears when the driving motor itself is defective or deteriorated. That is, in the present embodiment, such disturbance can be eliminated, and it is therefore seen that the constitution is strong against any defect or deterioration of a driving source.

It is to be noted that the present invention is not limited to the above-described embodiments, and can variously be modified within the scope of the present invention. For example, in the above-described embodiments, the stamping of the postage stamp portion of the mail matter with the postmark has been described. However, the present invention is not limited to this, and can also be applied to an apparatus for stamping paper sheets other than the mail matter.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A paper sheet stamp apparatus comprising:

a conveying mechanism adapted to convey a paper sheet at a constant speed via a conveying path;

a sensor configured to detect the conveyed paper sheet to acquire a stamp timing;

a stamp hub configured to stamp a first surface of the paper sheet detected by the sensor;

a backup roller adapted to rotate in a rolling contact with a second surface of the paper sheet so as to press the first surface of the paper sheet onto the stamp hub; and a first driving portion adapted to independently drive the stamp hub so as to rotate the stamp hub at the constant speed, when at least the stamp hub contacts the paper sheet, wherein the stamp hub includes an effective region in which a letterpress is formed and a non-contact region in which the hub does not roll-contact the first surface of the paper sheet on an outer peripheral surface of the hub, and the first driving portion accelerates and rotates the stamp hub stopped in a home position in which the non-contact region is disposed opposite to the conveying path so that the speed of the outer peripheral surface reaches the constant speed at a time when the effective region starts contacting the first surface, rotates the stamp hub at the constant speed when the effective region roll-contacts the first surface, and decelerates and stops the stamp hub in the home position after the effective region is detached from the first surface.

2. The paper sheet stamp apparatus according to claim 1, further comprising: a second driving portion adapted to drive the backup roller so that the backup roller rotates at the constant speed.

3. The paper sheet stamp apparatus according to claim 2, wherein the conveying mechanism comprises a conveying belt pair which runs in a holding/binding state of the opposite surfaces of the paper sheet at the constant speed, and the second driving portion allows the conveying belt pair to transmit a driving force so as to rotate the backup roller.

4. The paper sheet stamp apparatus according to claim 1, wherein the first driving portion comprises a motor directly connected to a rotation shaft of the stamp hub.

5. The paper sheet stamp apparatus according to claim 4, wherein the motor is an AC servo motor.

* * * * *